United States Patent [19]

Dinsdale

[11] Patent Number: 4,732,061

[45] Date of Patent: Mar. 22, 1988

[54] POWER TONGS AND CLAMPING UNITS THEREFOR

[75] Inventor: Michael C. Dinsdale, Dallas, Tex.

[73] Assignee: National-Oilwell, Houston, Tex.

[21] Appl. No.: 23,384

[22] Filed: Mar. 9, 1987

[51] Int. Cl.[4] ..... B25B 13/50

[52] U.S. Cl. ..... 81/57.34; 81/57.33; 81/57.19

[58] Field of Search ..... 81/54, 57.15, 57.16, 81/57.19, 57.21, 57.33, 57.34, 57.35, 57.44

[56] References Cited

U.S. PATENT DOCUMENTS 3,308,691 3/1967 Guier ..... 81/57.34

3,500,708 3/1970 Wilson ..... 81/57.35

*Primary Examiner*—Frederick R. Schmidt

*Assistant Examiner*—Maurina Rachuba

*Attorney, Agent, or Firm*—Roylance, Abrams, Berdo & Goodman

[57] ABSTRACT

A power tong has upper and lower clamping units mounted in a suspended support frame. Each clamping unit has pipe clamping jaws that move rectilinearly, and are actuated by a pressure fluid operated linear actuator. The lower clamping unit is rigidly secured to the supporting frame and the upper clamping unit is rotatable relative to the lower clamping unit. The relative rotation in both directions is accomplished by a remote powered actuator.

14 Claims, 22 Drawing Figures

POWER TONGS AND CLAMPING UNITS THEREFOR

FIELD OF THE INVENTION

This invention relates to power tongs for making and breaking threaded pipe connections, and to clamping units for such power tongs.

RELATED APPLICATION

Apparatus embodying the power tongs and clamping units claimed in this application is described and claimed in my copending application Serial No. (File 22613), filed concurrently herewith.

BACKGROUND OF THE INVENTION

While power tongs and the clamping units they employ are useful for making and breaking any threaded pipe connection, the primary commercial application for such devices today is in the drilling of wells.

In the drilling of oil, gas and geothermal wells, strings of drill pipe and other well pipe must be made up as the string is run into the well, and disassembled into individual lengths of pipe (referred to as joints) as the string is withdrawn from the well. The successive joints of well pipe are connected together by screw thread connectors. When the well depth is shallow, making and breaking the threaded connections can be done with relative ease, as by using pipe tongs manipulated by hand. In the case of deep wells, many more joints of pipe are required and it becomes necessary to speed up the making and breaking of the connnections between joints and to minimize manual labor. In all cases, it is desirable, and in the case of a deep well essential, to minimize the time required to accomplish a "trip" of the pipe out of and into the well. Thus, for example, to replace a worn drill bit the entire drill string must be pulled from the drill hole, with each of the many threaded connections being broken as the pipe is pulled, the drill bit then being replaced, and the entire string then being reassembled as the new bit and string are run into the drill hole. Prior art workers have accordingly developed power operated tongs of various kinds and power operated spinners, the power tongs being capable of initially breaking the threaded connections and of final tightening of them, and the power operated spinner serving to rotate the pipe rapidly during final unthreading of initial makeup of the connection.

The power tongs art is highly developed, both conceptually and commercially, as shown for example by the following U.S. Pat. Nos.

2,453,369—Grable et al.,
2,544,639—Calhoun,
2,705,614—McKibben et al.,
3,308,691—Guier,
3,629,927—Palmer et al.,
3,902,385—Haby,
3,961,399—Boyadjieff,
U.S. Pat. No. 4,348,920—Boyadjieff.

In usual form prior-art power tongs employ two sets of clamping jaws so arranged that, when the jaws are open, the jaws can accommodate a threaded pipe connection to be made or broken. Thus, one set of jaws can clamp the box of a pin-and-box connection, the other set of jaws clamping the pin. Power means is provided to operate the jaws to clamp and release the respective parts of the connection. The arrangement is such that, when the jaws are clamped on the parts of the threaded pipe connection, at least one set of jaws can be swung, relative to the other set, about the axis of the threaded connection to make or break the same. In some cases, movement of the jaws to clamp and release is pivotal. In other cases, the jaws are moved rectilinearly toward and away from the threaded pipe connection. In all cases, the two sets of jaws, and any structure associated directly therewith, must present an opening such that, initially spaced from the pipe connection, the jaws can be moved laterally of the pipe until the connection is accommodated by the opening. While it is usual for the two sets of jaws each to engage a different part, e.g., the pin and the box of a conventional drill pipe connector, one or both of the sets of jaws may engage the pipe itself, rather than a part of the threaded connector.

Though such prior-art power tongs have achieved extensive commercial acceptance, particularly for use on well drilling rigs, numerous problems have arisen and there has been a continuing need for improvement. Some of those problems arise from the need to have the power tongs capable of operating on vertical pipe, such as pipe extending into a well, and also upon inclined pipe, such as pipe disposed in the so-called "mousehole" receptacle of a well drilling rig. Another problem is that such tongs tend to be relatively massive, complicated and expensive to manufacture.

SUMMARY OF THE INVENTION

Tongs and clamping units according to the invention make it possible to provide a complete power tongs unit useful, for example, in an apparatus of the type claimed in my copending application Ser. No. 023,385, with the power tongs unit being unusually compact and relatively simple. The power tongs unit is particularly adapted to be supported by a suspended frame in such fashion that the frame can be easily moved laterally of the pipe and easily swung to adapt to varying positions of the pipe. Such advantages are achieved by having the jaws move rectilinearly, rather than being pivoted between clamping and release positions, and by providing improved means for actuating both jaws by means of a conventional pressure fluid operated double acting linear actuator.

Considered broadly, clamping units according to the invention comprise a rigid support, typically comprising two plates which are spaced apart and rigidly secured together, the support having an opening which opens through the front thereof to allow the threaded connection which is to be made or broken to enter the support as a result of movement of the support laterally relative to the threaded connection. Two jaw members are carried by the support in such fashion as to be opposed across the opening, and thus across the threaded connection, in such fashion that the jaw members can be moved toward each other, to clamp, and away from each other, to release. Two jaw actuating levers are provided, each disposed between a respective side of the support and a corresponding one of the jaw members, each lever being mounted on the support for pivotal movement about an axis parallel to the axis of rotation of the support, each of the levers having a front portion projecting forwardly from the axis of pivotal movement of the lever and a back portion projecting rearwardly from the axis of pivotal movement of the lever. A remotely operable double acting linear power device, typically a pressure fluid operated device having a cylinder, piston and piston rod, is connected between the ends of the back portions of the two jaw actuating levers and operates to pivot the levers in a first direction when the power device operates in one direction and a second direction when the power device operates in the opposite direction. The jaw actuating levers are operatively connected to the jaw members to move the jaw members toward each other, to clamp, when the power device is operated in said one direction, and away from each other, to release, when the power device is operated in said opposite direction.

The rigid support of at least one of the clamping units is adapted to be so mounted in the power tongs as to be rotatable, relative to the other clamping unit, about the longitudinal axis of the threaded pipe connection to be made or broken. Typically, the power tongs can include a suspended support frame which carries both clamping units, the lower clamping unit is rigidly secured to the frame, and the upper clamping unit is rotatable relative to the lower unit. Remotely operated power means is provided for accomplishing such relative rotation, with the relative rotation being powered in both directions.

IDENTIFICATION OF THE DRAWINGS

DETAILED DESCRIPTION OF THE INVENTION

Apparatus Shown in FIGS. 1–8

Figure 1:
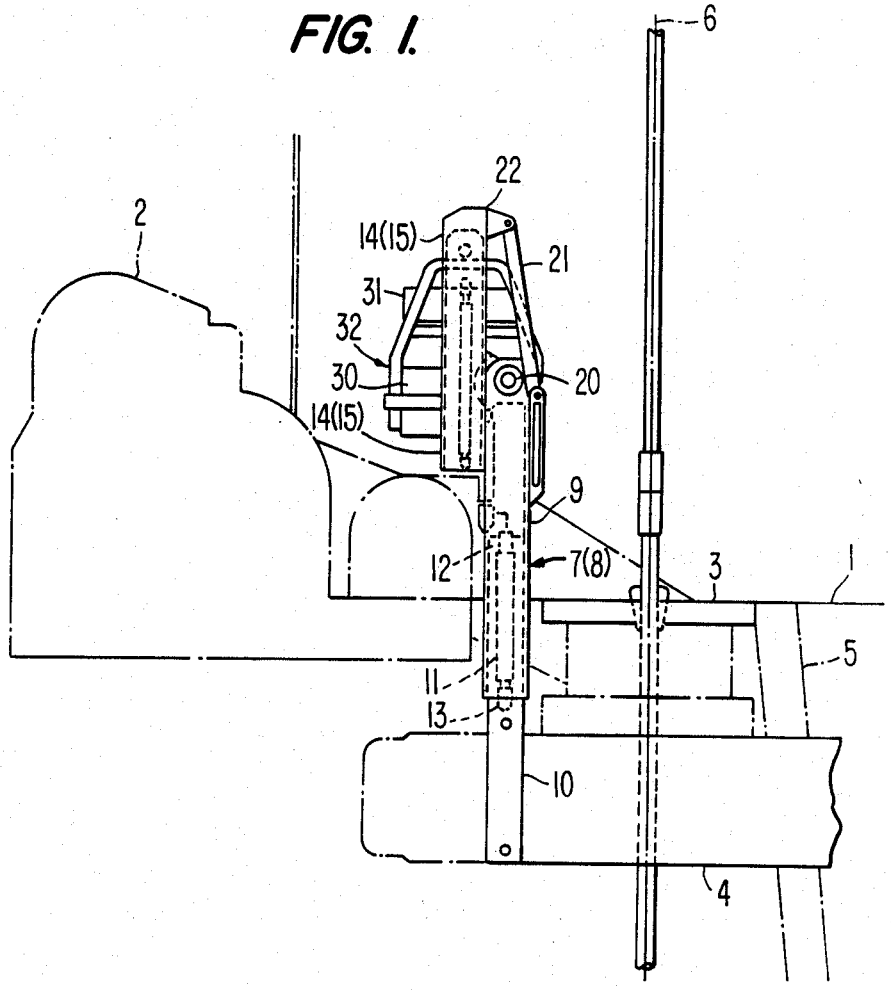
FIG. 1 is a semi-diagrammatic side elevational view of apparatus including power tongs according to the invention, showing the movable support frame in the stowed position.
Figure 2:
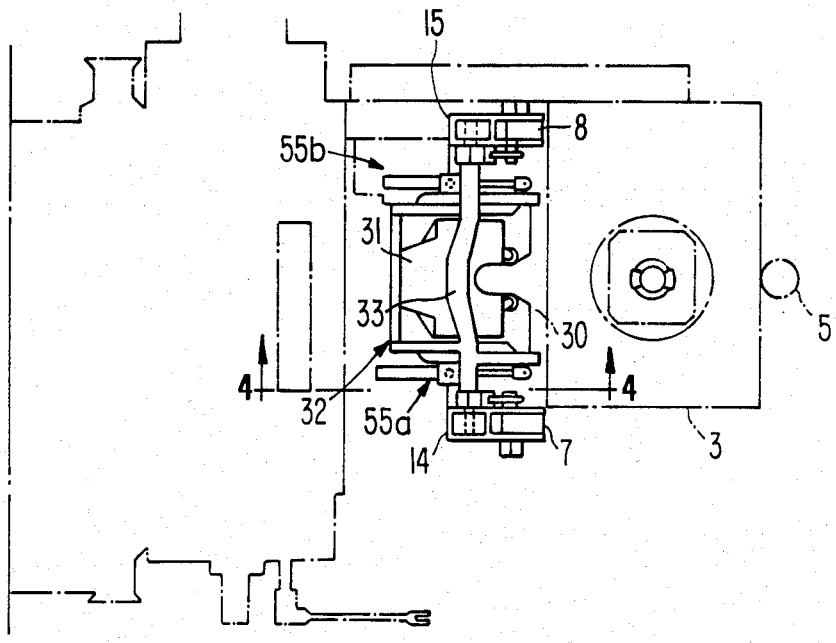
FIG. 2 is a top plan view of the apparatus with the parts disposed as in FIG. 1.
Figure 3:
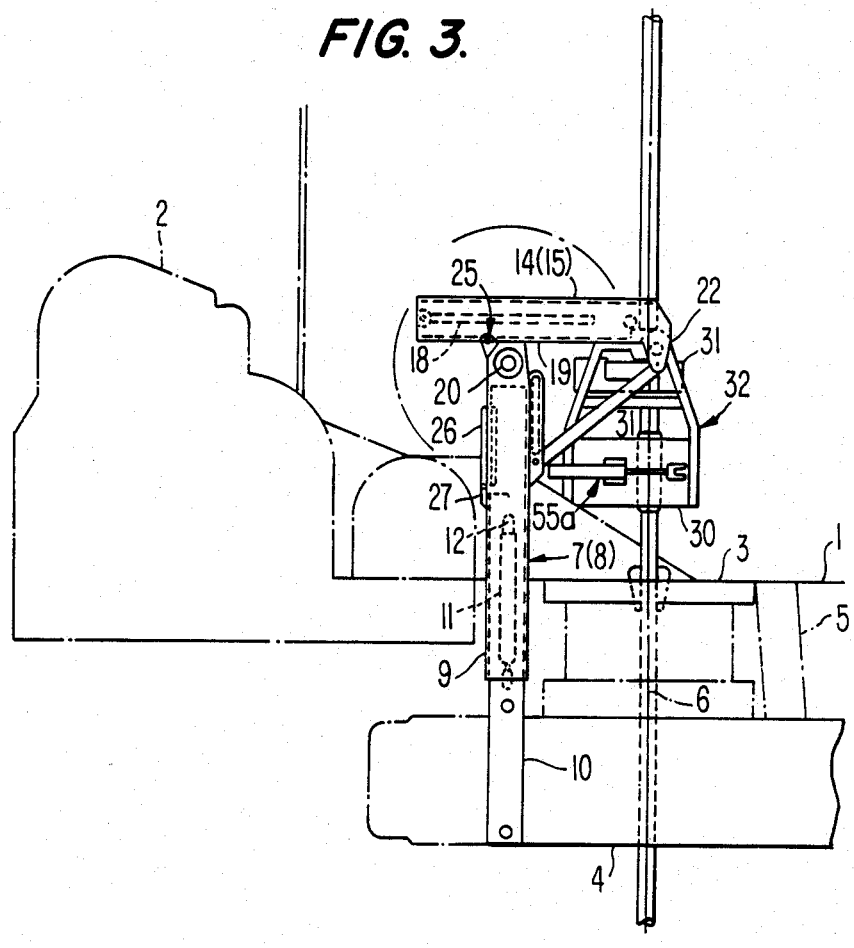
FIG. 3 is a view similar to FIG. 1 but showing the movable support frame in the well center position.
Figure 4:
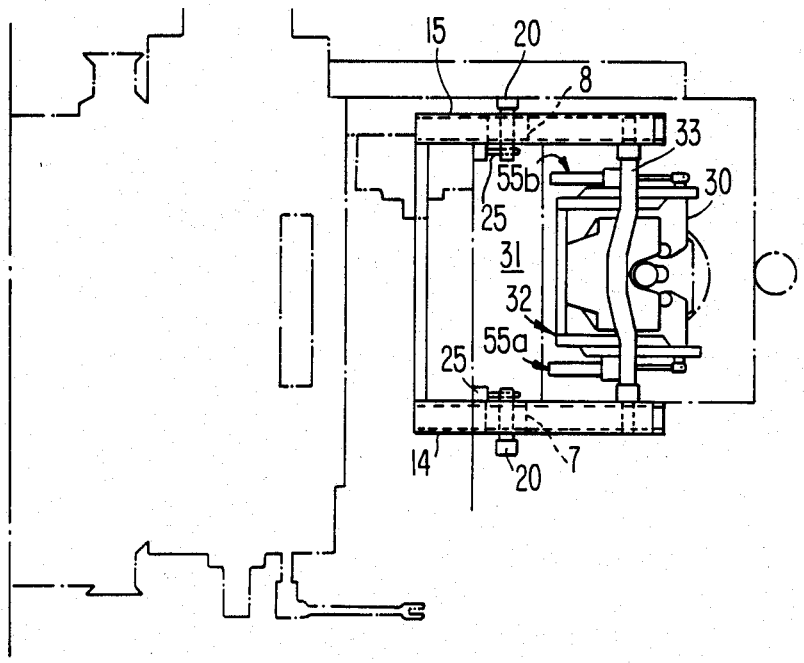
FIG. 4 is a top plan elevational view of the apparatus with the parts in the positions seen in FIG. 3.

The apparatus is mounted on a conventional drilling rig including a rig floor 1, drawbacks 2, rotary table 3, rotary table beams 4 and mousehole receptacle 5. In usual fashion, the rotary table 3 defines the well bore axis 6 and, therefore, the well center position. The drawworks is spaced laterally from the well center position by a considerable distance, and the mousehole receptacle is spaced from the well center on the side opposite the drawworks and is located between the rotary table beams.

The stationary support of the apparatus comprises two vertical legs 7 and 8, the two legs being identical and telescopically extendable and retractable. Thus, each leg 7, 8 is hollow, of rectangular transverse cross section and comprises a hollow upper member 9 within which is telescopically disposed the upper end portion of a lower member 10. A conventional double acting hydraulically operated linear actuator extends longitudinally within the hollow leg and has the upper end of its cylinder 11 pivotally connected at 12 to upper leg member 9, as by a conventional cross pin and clevis, the free end of the piston rod 13 being similarly connected to the lower leg member 10. The actuators can thus be operated to simultaneously extend both legs 7, 8 from the shortened condition of FIG. 1 to the extended condition of FIG. 5 and back to the shortened condition.

Mounted on upper members 9 of the legs are two mutually identical pivoted support and positioning arms 14 and 15 which are telescopically extendable and retractable. Each arm 14, 15 comprises a hollow first member 16, FIG. 5, of larger rectangular transverse cross section and a second member 17 of smaller rectangular transverse cross section, member 17 extending telescopically within member 16. A conventional double acting hydraulically operated linear actuator 18 extends longitudinally within each arm 14, 15 and has the blind end of its cylinder pivotally connected to member 16 and the free end of its piston rod connected to member 17, the arrangement being such that simultaneous operation of actuators 18 can extend the arms telescopically from the shortened condition seen in FIGS. 1 and 3 to the extended condition seen in FIG. 5 and back to the shortened condition.

Each arm 14,15 is equipped with a flange 19 projecting laterally from member 16 of the arm in the plane of that side of member 16 nearer the other arm, each flange 19 being rigidly secured to a horizotanl shaft 20 journalled in the upper end of member 9 of the corresponding leg 7,8. A brace 21 is provided for each arm 14 and 15, the brace being pivoted at one end to a flange 22 on the end of member 16 most distant from shaft 20. The other end of each brace 21 has a lateral projection 23 engaged in a vertical slot 24 in a flange secured to to and extending along the upper portion of member 9 of the corresponding leg. Arms 14,15 are thus pivotable about the common axis of shafts 20 between the vertical position seen in FIG. 1 and the horizontal position seen in FIGS. 3–6.

Two crank arms 25 are provided, each secured rigidly to one of a different one of shafts 20 and projecting radially therefrom. Two conventional double acting hydraulically operated linear actuators 26 each have the free end of their piston rods pivotally connected to the free end of a different one of the crank arms 25, the blind end of the cylinders **26*a* of actuators 26 being pivoted to a different one of two flanges 27 each secured to a different one of leg members 9 a substantial distance below shafts 20. The arrangement is such that, when the piston rods of actuators 26 are simultaneously driven downwardly, arms 14,15 are pivoted counterclockwise as viewed in FIG. 1 until the arms are vertical and each extends adjacent to the side of the respective leg member 9 most distant from the well center. When the piston rods of actuators 26 are driven in the opposite direction, arms 14,15 are pivoted clockwise, as viewed in FIG. 1, to the horizontal position seen in FIGS. 3–6. Projections 23 remain engaged in slots 24** at all times, traveling to the upper ends of the slots when the support and positioning arms are swung to their vertical position and to the lower ends of the slots as the arms are swung to their horizontal positions.

Figure 7:
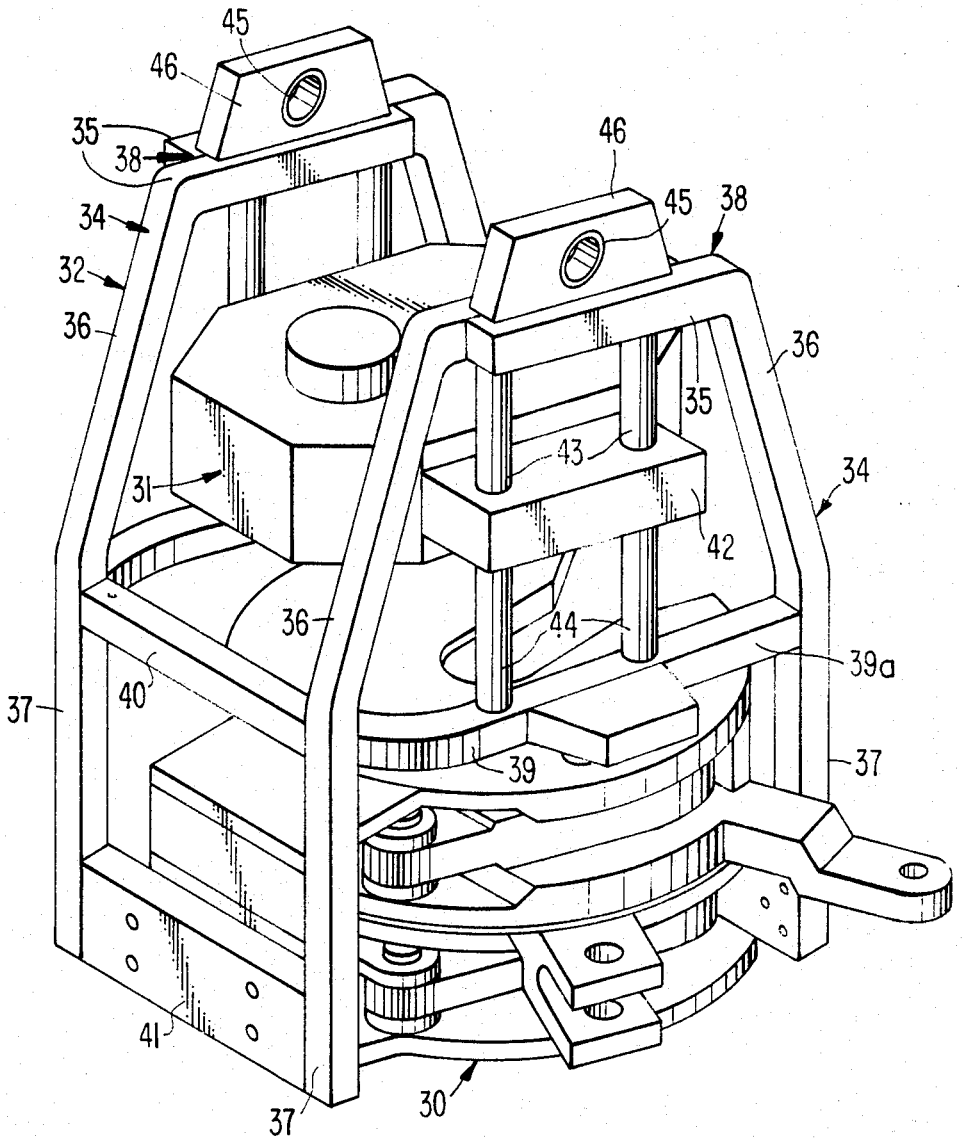
FIG. 7 is an isometric view of the movable support frame with tongs and spinner in place but with some parts removed for clarity of illustration.
Figure 8:
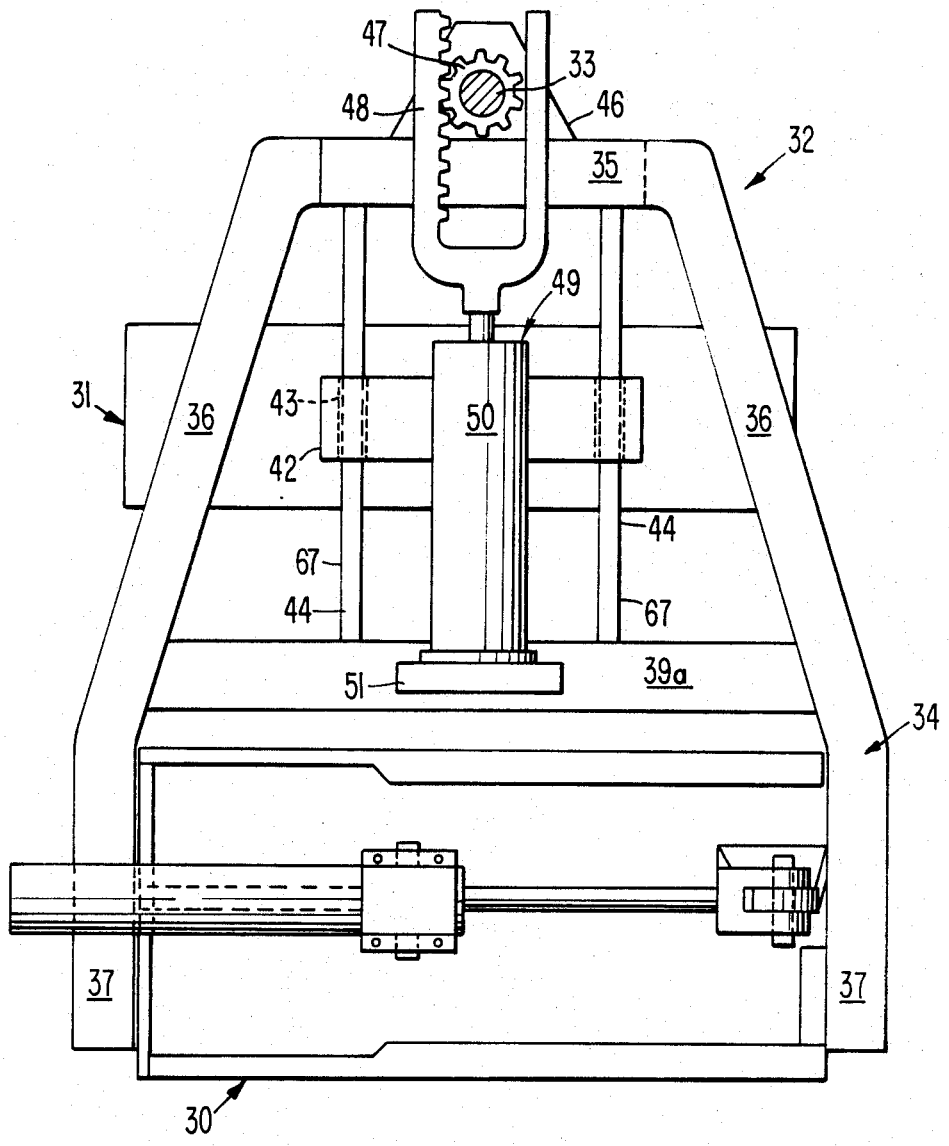
FIG. 8 is a side elevational view of the structure shown in FIG. 7, with power actuators in place.

The power tongs, indicated generally at 30, and a conventional power spinner 31 are carried by a movable support frame indicated generally at 32. Frame 32 is suspended from a horizontal shaft 33, FIGS. 2 and 4, which, in this embodiment, is secured rigidly to and extends between the outer ends of member 17 of supporting and positioning arms 14,15. Frame 32 comprises four identical members 34, FIGS. 7 and 8, each formed from an integral metal bar and having the general shape of an inverted L, the feet 35 of the L being straight and relatively short and the stems of the L being bent to provide straight portions 36 and 37. Each side member 38 of the frame is made up of two members 34 with the feet 35 thereof welded together side-by-side so that portions 35 are horizontal at the top of the frame, portions 36 diverge downwardly and outwardly, and portions 37 depended vertically, when the frame is upright as seen in FIG. 7. At the junctures between portions 36 and 37 of members 34, each side member 38 has a cross brace 39 having a straight portion **39*a* disposed in the same plane as the foot 35 which is outermost in the completed frame. Viewed as in FIG. 7, frame 32 can be considered as having a front and a back. At the back of the frame, side members 38 are connected by a cross brace 40 joined to the corresponding junctures between portions 36 and 37 of the respective members 34. A second cross brace 41 interconnects the lower ends of the respective portions 37. As hereinafter described, power tongs unit 30 is secured to cross brace 41 and to the lower ends of the portions 37 which are at the front of frame 32. Power spinner 31 has two oppositely projecting side flanges 42 provided with laterally spaced vertical bores 43. At each side of the spinner, two vertical guide rods 44 each extend through a different one of the bores 43 and are rigidly secured to portion 39a of cross brace 39 and the portion 35 aligned thereabove so that, while the spinner is restrained against lateral movement relative to the frame, the spinner is free for limited vertical movement relative to the frame. Shaft 33 extends through coaxially aligned bushings 45 carried by two brackets 46 each welded to and projecting upwardly from the top of a different one of side members 38, so that the combination of frame 32, power tongs 30 and spinner 31, while securely supported by shaft 33**, is free to swing about the horizontal axis defined by the shaft and bushings.

Advantageously, relative pivotal movement between frame 32 and shaft 33 is accomplished by remote operation in timed relation to operation of the actuators which swing support arms 14 and 15, extend and retract the support arms and extend and retract legs 7 and 8. To accomplish this, frame 32 must be swung by power means. Accordingly, shaft 33 has one end portion which projects beyond the corresponding bracket 46 and a pinion 47 is fixed rigidly to the projecting end portion of the shaft. The pinion is meshed with a rack 48 secured to the end of the piston rod of a conventional double acting hydraulically powered rectilinear motor 49. The blind end of the cylinder 50 of motor 49 is secured to a mounting bracket 51 which is fixed to and projects laterally from portion 39a of cross brace 39. As support arms 14 and 15 are swung clockwise (as viewed in FIGS. 3 and 5) from the vertical position of FIG. 1 to the horizontal position of FIG. 3, motor 49 is operated to retract its piston rod to turn pinion 47 in a direction tending to swing frame 32 in a counterclockwise directions, the rate of operation of motor 49 being such that frame 32 remains vertical as the support arms are swung from vertical to horizontal. When the support arms are swung back to the vertical position, motor 49 is operated to extend its piston rod and thereby turn pinion 47 in a direction which tends to swing frame 32 clockwise relative to the support arms and at a rate maintaining frame 32 vertical.

Figure 11:
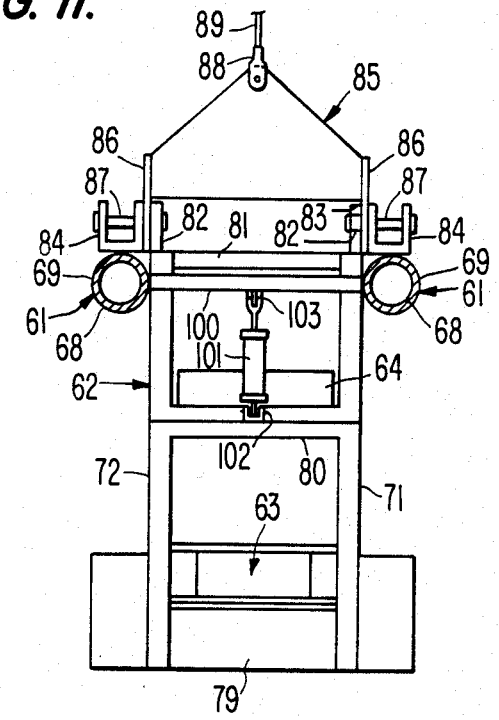
FIG. 11 is a fragmentary view, partly in vertical cross section, taken generally on line 11—11, FIG. 9.
Figure 9:
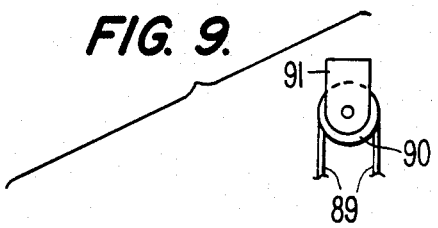
FIG. 9 is a side elevational view of apparatus according to another embodiment of the invention, with the movable support frame in well center position.
Figure 10:
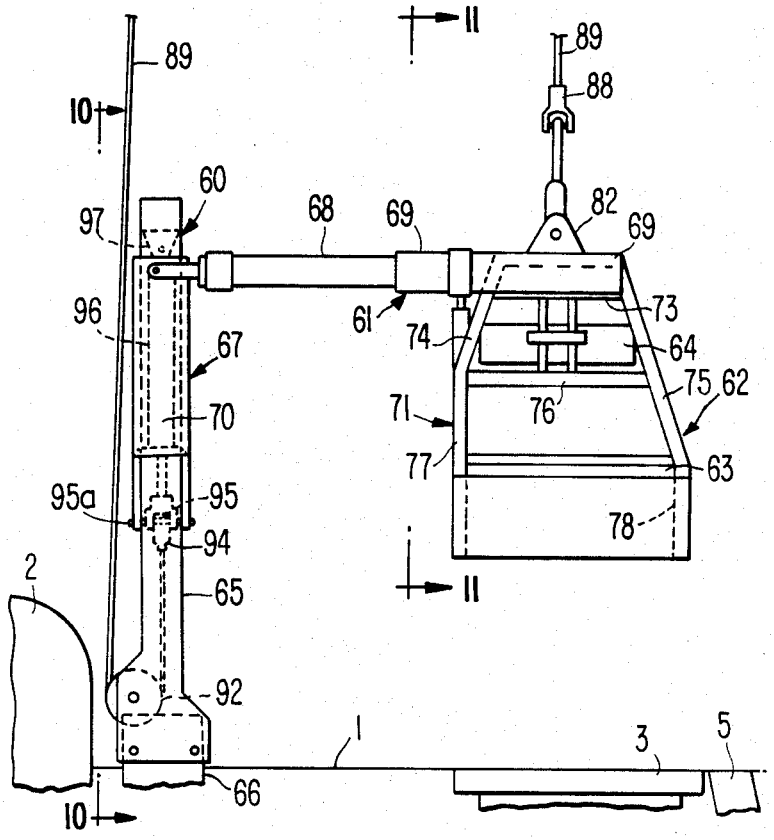
FIG. 10 is an elevational view taken generally on line 10—10, FIG. 9.
Figure 10:
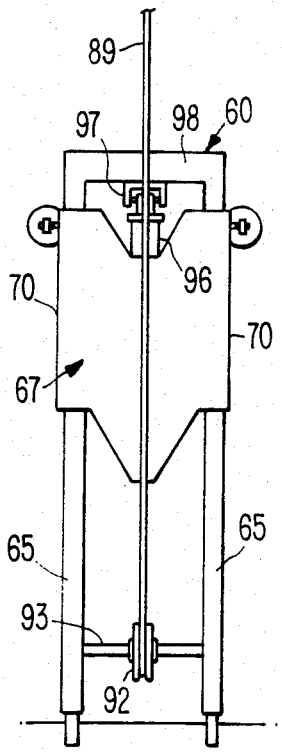

The Embodiment Shown in FIGS. 9–11

The apparatus of this embodiment of the invention is again adapted for mounting on a conventional drilling rig floor 1 having a drawworks 2, a rotary table 3 and a mousehole receptacle 5. The apparatus comprises an upright support frame 60, two parallel telescopically extendable and retractable arms 61 and a movable support frame 62 on which are mounted the power tongs 63 and power spinner 64.

Support frame 60 comprises two mutually parallel legs 65 which are spaced apart and each secured to the substructure at the rig floor by a mounting bracket 66. A vertical slide beam 67 of open rectangular horizontal cross section slidably embraces legs 65 so as to be movable upwardly and downwardly along support frame 60. Arms 61 each comprise a hollow cylindrical portion 68 of smaller diameter and a hollow cylindrical portion 69 of larger diameter, the two portions being telescopically engaged and the free ends of portions 68 being pivotally connected to the respective sides 70 of slide beam 67, as shown.

Movable support frame 62 comprises two flat sides 71 and 72 which are mutually parallel. Each side 71, 72 includes a top member 73, a shorter straight portion 74 and a longer straight portion 75, portion 74 slanting downwardly and rearwardly from the corresponding end of member 73 and portion 75 slanting downwardly and forwardly from the opposite end of member 73. A cross brace 76, parallel to member 73, has its ends connected respectively to the lower end of portion 74 and an intermediate point along the length of portion 75. A longer straight portion 77 depends from the lower end of portion 74 and a shorter straight portion 78 depends from the lower end of portion 75. At the bottom of the frame, portions 77 are interconnected by a cross brace 79, and a second cross brace 80 connects the junctures between portions 75 and 77 of the two sides. At the top of the frame, sides 71 and 72 are connected by a flat plate 81. Power tongs 63 are mounted on the lower portion of frame 62, as by being secured to cross brace 79 and structure at the lower ends of portions 78. Power spinner 64 is mounted on the upper portion of frame 62, as in the manner hereinbefore described for spinner 31 of FIGS. 1–8. The front of frame 62 is open to allow the tongs and spinner to engage a threaded pipe connection or a joint of pipe.

Rigidly secured to the upper edges of the respective top members 73 of the sides of frame 62 are two upwardly projecting support flanges 82 each apertured to accommodate a bushing 83, the bushings being coaxially aligned to establish a pivotal axis extending at right angles to the sides of the frame. Rigidly secured to each of the larger diameter portions 69 of the support arms 61 is an upwardly projecting clevis flange 84. A spreader beam 84 is provided and includes apertured flanges 86 which are spaced apart by a distance allowing the flanges to lie adjacent the outer faces of the respective support flanges 82. Stub shafts 87 are provided for each support flange 82, each shaft 85 extending through the corresponding bushing 83, the aperture of the corresponding flange 86 of the spreader beam, and the apertures of the corresponding clevis flange 84.

In a location spaced above flanges 86 and centered therebetween, spreader beam 85 has an aperture accommodating the pin of a cable clevis 88 fixed to one end of a cable 89. From clevis 88, the cable extends upwardly and over a sheave 90, FIG. 9, rotatably supported by flanges 91 secured to an upper portion of the drilling rig tower (not shown). From sheave 90, cable 89 extends downwardly and is run beneath a second sheave 92 carried by a shaft 93 extending between lower portions of legs 65 of frame 60. From the second sheave, the cable is routed upwardly and secured by cable eye 94 and rod clevis 95 to the free end of the piston rod of a hydraulically powered rectilinear power device 96 which is located within slide beam 67 and has the blind end of its cylinder pivotally connected by clevis 97 to cross beam 98 at the top of frame 60. Pin 95a, which connects cable eye 94 to clevis 95, also connects clevis 95 to slide beam 67.

Larger portions 69 of support arms 61 are rigidly interconnected by a cross brace 100. A hydraulically powered rectilinear power device 101 has the blind end of its cylinder secured to cross brace 80 by clevis flange 102, the free end of the piston rod of the power device being connected to cross brace 100 by clevis flange 103. Operation of power device 101 to extend its piston rod swings frame 62 about the axis defined by bushings 83 in a counterclockwise direction relative to support arms 61. Operation of the power device in the opposite direction swings frame 62 clockwise relative to the support arms.

Power device 96 serves as means for determining the vertical position of support frame 62. Thus, operation of device 96 to extend its piston rod moves the combination of slide beam 67, support arms 61 and frame 62 downwardly while support arms 61 retain their generally horizontal position because of the action of cable 89 and sheaves 90 and 92. Operation of power device 96 in the opposite direction moves the combination of the slide beam, support arms and support frame upwardly.

It will be apparent that the extent of upward and downward movement of the support frame is determined by the extent of retraction or extension of the piston rod of power device 96. At least one of the support arms 61 is provided with a conventional double acting hydraulically operated linear actuator (not shown) housed within the support arm in the general manner hereinbefore described with reference to the embodiment of FIGS. 1–8 and operative to extend and retract arms 61. Accordingly, arms 61 can be retracted to move frame 62 to a stowed position between the well center and frame 60, extended to move frame 62 to bring the power tongs and power spinner into alignment with the well center, and further extended to bring frame 62 to the mousehole position. During such further extension, or after completion thereof, power device 101 is operated to extend its piston rod and swing frame 62 counterclockwise to the proper angle for alignment of the power tongs and spinner with mousehole receptacle 5. Power devcie 101 is operated to retract its piston rod and return frame 62 to the vertical position when the frame is returned to its well center position.

Power Tongs and Clamping Units Shown in FIGS. 12–19

FIGS. 12–19 illustrate one particularly advantageous form of power tongs according to the invention, the tongs comprising an upper tongs unit, indicated generally at 105, and a lower tongs unit, indicated generally at 106. For convenience and clarity, both units will be described as having a front, via which the well pipe or pipe connector will enter, and a back and it will be assumed that the units are viewed from the back looking forward, so as to have a left side and a right side. Unit 105 comprises a flat upper plate 107 and a flat lower plate 108 which are spaced apart vertically and rigidly interconnected by a rectangular plate 109 at the back, a flat intermediate partition 110, and two coplanar front plates 111. Unit 106 similarly comprises a flat upper plate 112 and a flat lower plate 113 spaced apart vertically and secured rigidly together by flat back plate 114, flat intermediate partition 115 and two front plates 116.

Figure 12:
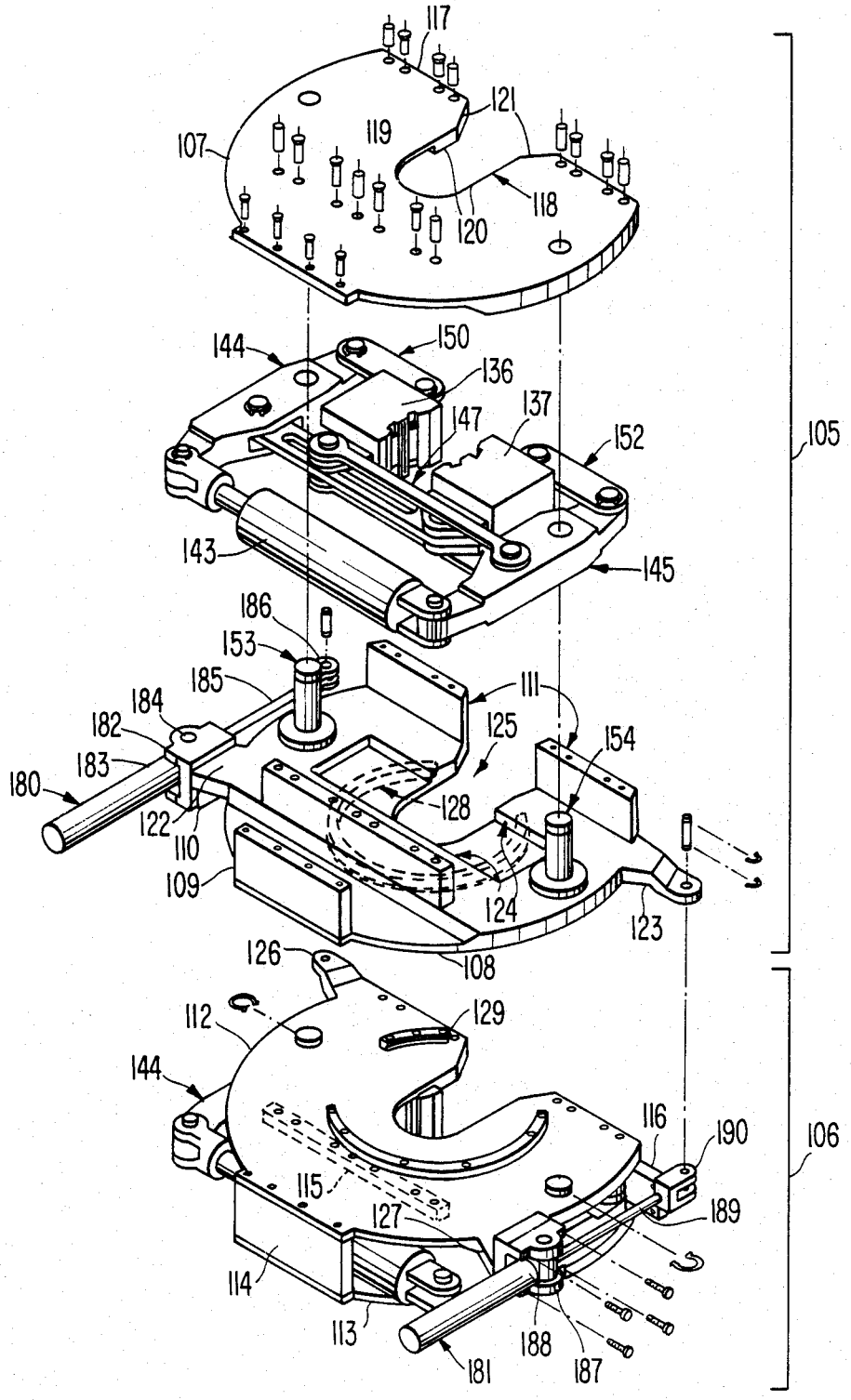
FIG. 12 is an isometric view of power tongs according to the invention, the upper tong assembly shown exploded, the lower tong assembly shown assembled.

The periphery of upper plate 107 extends as part of a circle interrupted by straight front edge portions 117 which extend chordally with respect to the circular peripheral portion, are mutually aligned and are spaced each on a different side of an elongated generally U-shaped opening 118 sized to accommodate a threaded connector or tool joint. Opening 118 is defined by a semicircular base or inner edge 119, parallel side edges 120 extending forwardly from the base, and divergent edge portions 121 joining the inner ends of edge portions 117 at the mouth of the opening. The plan form of lower plate 108 is identical to that of plate 107 save that plate 108 has an integral outwardly projecting left lug 122, aligned generally with the position of intermediate partition 110, and an integral outwardly projecting lug 123 at the right front edge portion 117. From the location of intermediate partition 110 forwardly, plates 107 and 108 are relatively thick. From the location of partition 110 rearwardly, the thickness of both plates is markedly reduced by cutting material away from the lower face of plate 107 and from the upper face of plate 108 so that the space between the portions of the plates behind partition 110 is greater than that between the portions of the plates in front of partition 110. Forwardly of partition 110, lower plate 108 has a rectangular upwardly opening recess 124 the long dimension of which is parallel to partition 110, recess 124 being centered on opening 125, as seen in FIG. 12.

Upper plate 112 of unit 106 is identical with the upper plate of unit 105 except for having an integral outwardly projecting left lug 126, aligned with the left front edge of the plate, and an integral outwardly projecting right lug 127 aligned generally with the position of intermediate partition 115. A partial ring 128 is secured to the lower face of bottom plate 108 of upper unit 105 is concentric with the center of curvature of inner edge 119 of opening 118. Two arcuate ring portions 129 are secured to the upper face of top plate 112 of unit 106 and lie on a circle concentric with the center of curvature of the inner edge of the tool joint-accommodating opening of plate 12, the circle defined by ring portions 129 being of slightly larger diameter than that of partial ring 128 so that, in the assembled tongs, partial ring 128 is slidably embraced by ring portions 129.

Figure 13:
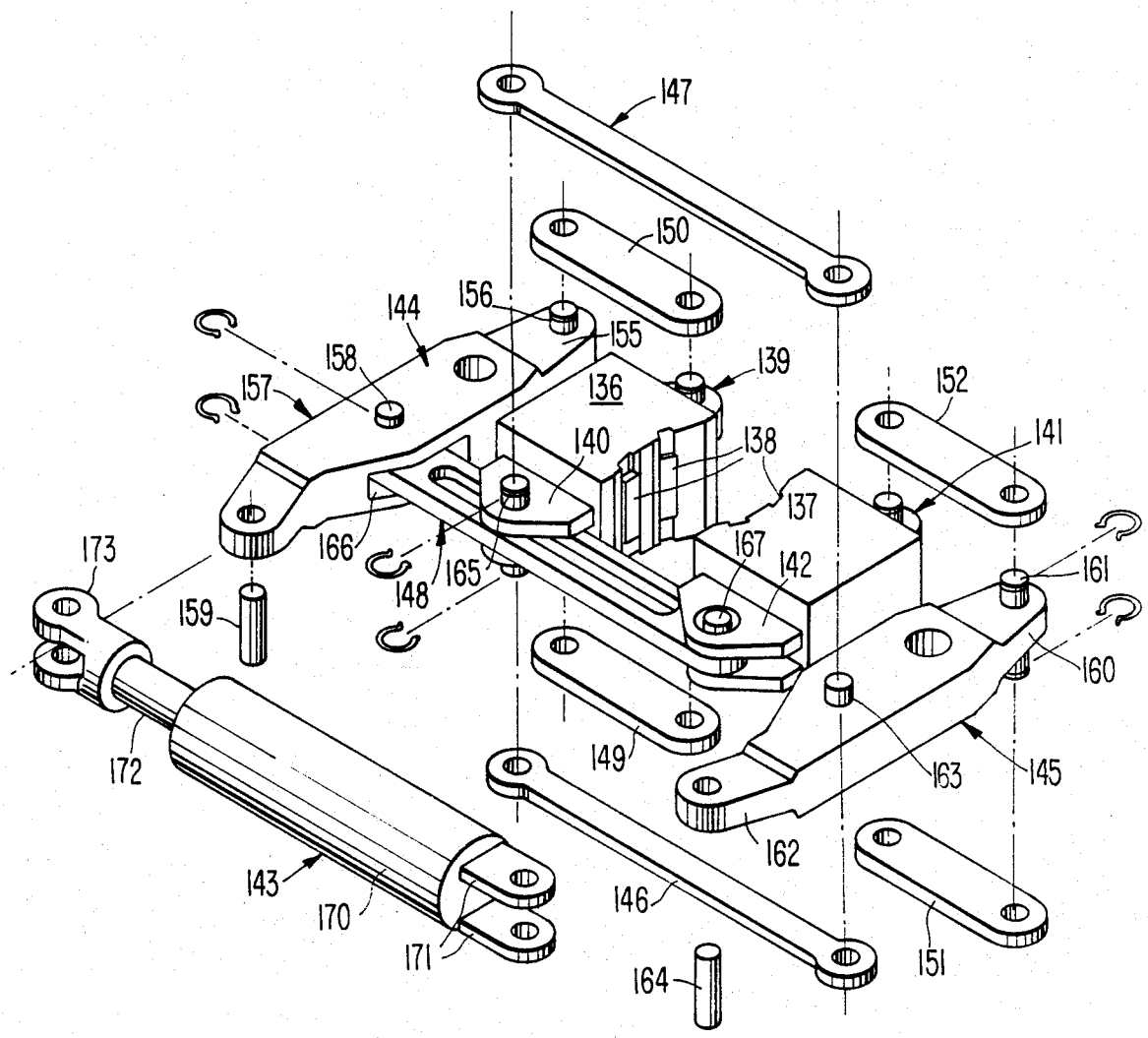
FIG. 13 is an exploded isometric view of the clamp assembly, typical for both the upper and lower tongs of FIG. 12.
Figure 14:
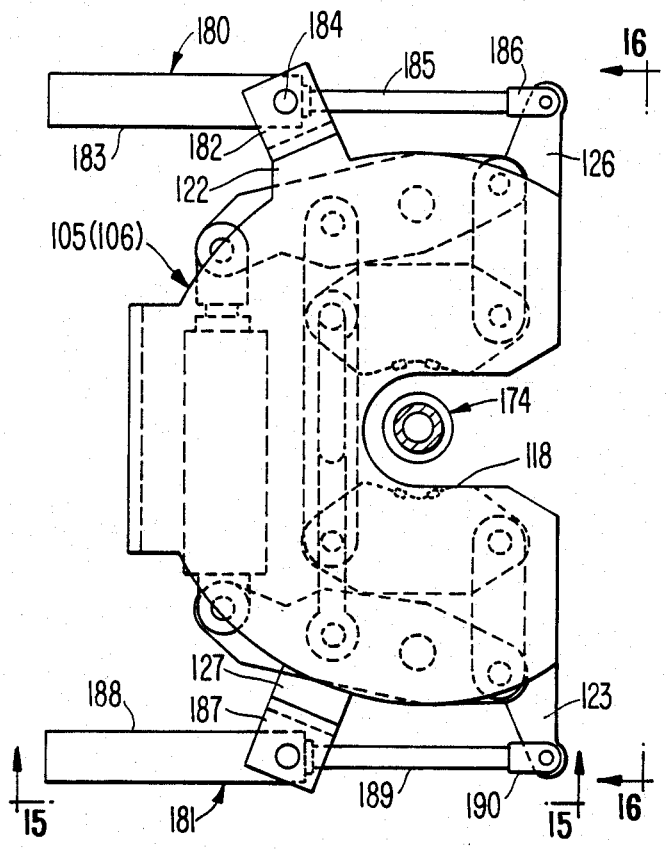
FIG. 14 is a top plan elevational view of the tongs of FIG. 12, showing the apparatus operatively oriented with respect to well pipe but not clamped.

Units 105 and 106 comprise identical clamp assemblies one of which is indicated generally at 135, FIGS. 12 and 13, and will be described in relation to upper unit 105. Each clamp assembly comprises two opposed jaw members 136 and 137 each of generally parallelepiped form save that the opposed clamping faces are arcuate and equipped with gripping elements 138. The jaw members are located between intermediate partition 110 and front plates 111 and seated slidably in recess 124 of bottom plate 108. As best seen in FIG. 13, there are rigidly secured to jaw member 136 a forwardly projecting lug 139 and a rearwardly projecting clevis bracket 140, the lug and clevis bracket being respectively secured to the front and back sides of the jaw member. Similarly, jaw member 137 is equipped with a forwardly projecting lug 141 and a rearwardly projecting clevis bracket 142. The jaw members are actuated by the combination of hydraulically powered linear actuator 143, two actuating levers 144 and 145, and linkage means comprising links 146–152.

Lever 144 is mounted for pivotal movement about a precisely fixed vertical axis determined by a vertical pivot shaft 153 extending between and secured to plates 107 and 108. Lever 145 is similarly mounted by pivot shaft 154. Lever 144 includes a shorter front arm portion 155 which projects forwardly from shaft 153 and is equipped with a vertical pivot pin 156, the lever also including a longer back arm portion 157 which projects rearwardly from shaft 153, has a vertical pivot pin 158 projecting both upwardly and downwardly from a point intermediate the length of portion 157, and terminates in an end portion apertured to receive a vertical pivot pin 159. Similarly, lever 145 includes forwardly projecting shorter front arm portion 160, pivot pin 161, rearwardly projecting longer back arm portion 162, and pivot pins 163 and 164. Link 146 extends parallel to the front face of intermediate partition 110 and has one end connected to the bottom end of pivot pin 163 of lever 145 and the other end connected to the bottom end of pivot pin 165 of clevis bracket 140. Link 147 is similarly pivotally connected to lever 145 and bracket 140 by the upper ends of pins 163 and 165. Lever 144 has a slot 166 which opens toward clevis bracket 140 and through which pin 158 extends. Link 148 is slotted for a major portion of its length and pin 165 of clevis bracket 140 extends freely through the slot, the respective ends of link 148 being pivotally connected to pin 158 of lever 144 and pin 167 of clevis bracket 142. Links 149 and 150 are connected respectively between the bottom ends and the top ends of pin 155 of lever 144 and pin 168 of lug 139. Similarly, links 151 and 152 are connected respectively between the bottom ends of pin 161 of lever 145 and pin 169 of lug 141. Power device 143 includes cylinder 170, clevis 171 at the blind end of the cylinder, piston rod 172, and clevis 173 at the free end of the rod. Clevis 171 is pivotally connected to the free end of portion 162 of lever 145 by pin 164. Clevis 173 is pivotally connected to the free end of portion 157 of lever 144 by pin 159.

Figure 16:
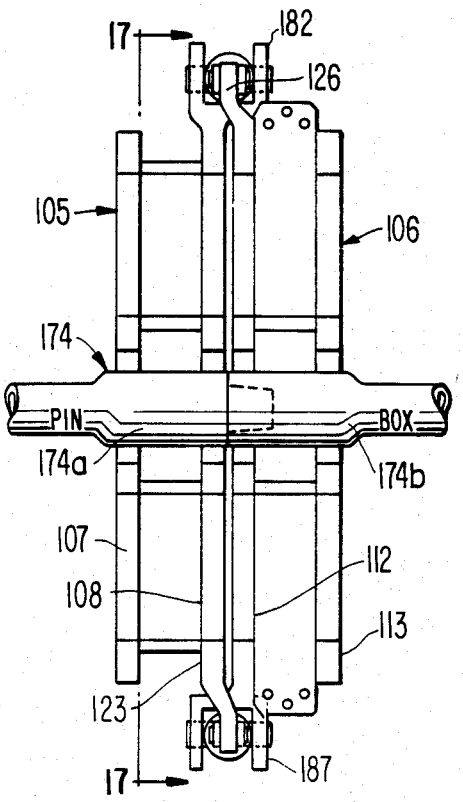
FIG. 16 is a front elevational view taken generally on line 16—16, FIG. 14.
Figure 15:
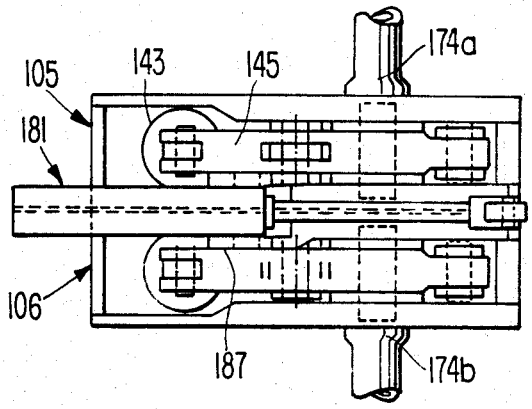
FIG. 15 is a side elevational view taken generally on line 15—15, FIG. 14.
Figure 17:
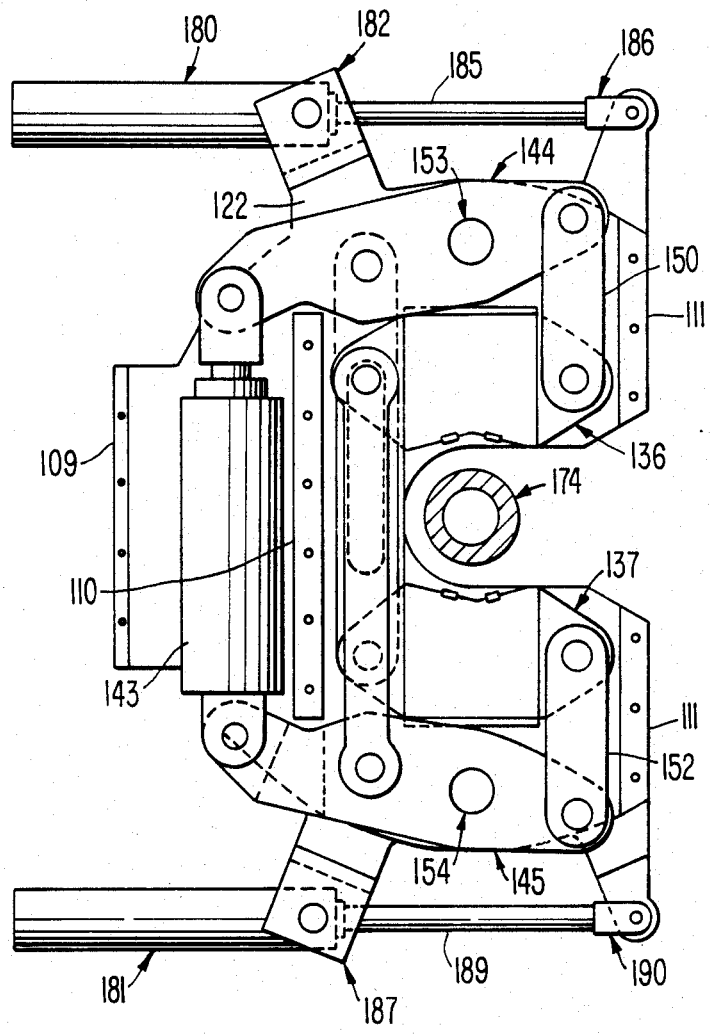
FIG. 17 is a sectional view taken generally on line 17—17, FIG. 16, with the tongs unclamped.
Figure 18:
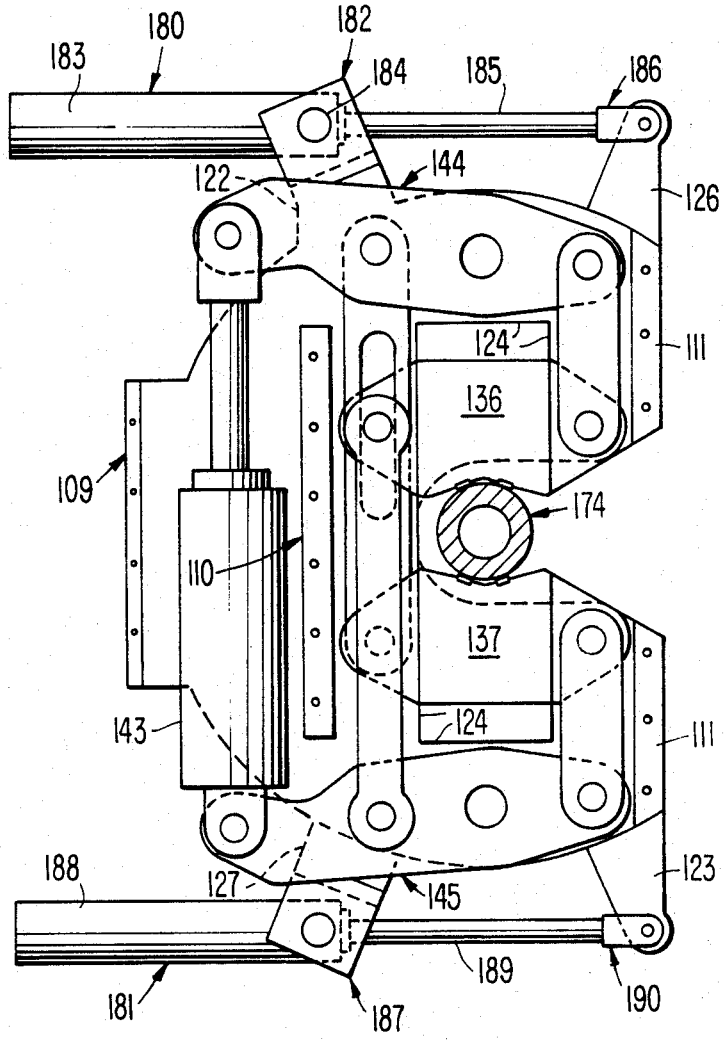
FIG. 18 is a view similar to FIG. 17 but with the tongs clamped on a threaded connector.
Figure 19:
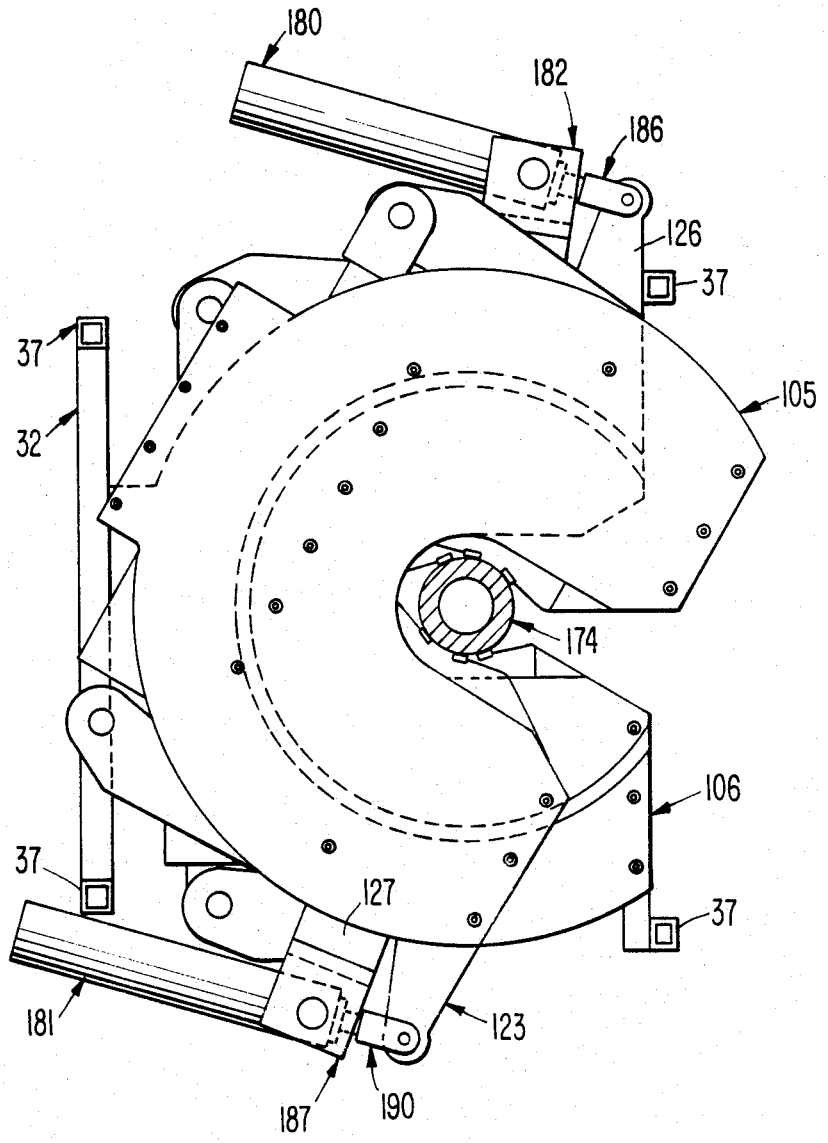
FIG. 19 is a view similar to FIG. 14 showing the tongs clamped and with the upper tongs having been actuated to tighten the threaded pipe connection, FIG. 19 including elements of the movable support frame.

When power device 143 is operated to retract its piston rod, arm portions 157 and 162 of levers 144 and 145 are swung toward each other, pivoting about shafts 153 and 154 and causing jaw members 136 and 137 to move away from each other to the fully retracted positions shown in FIG. 17. With the jaw members thus fully retracted, openings 118 and 125 are fully open to receive, e.g., the threaded pipe connection 174. When power device 143 is operated to extend its piston rod, arm portions 157 and 162 of levers 144 and 145 are swung away from each other, causing jaw members 136 and 137 to move toward each other and come into clamping engagement with the pipe connection, as seen in FIG. 18. During movement in either direction, the jaw members are restrained to move rectilinearly because seated in recess 124. As will be clear from FIG. 16, the clamp assembly of upper tongs unit 105 engages upper element **174*a* of the threaded connector 174 while the clamp assembly of lower tongs unit 106 is disposed to engage the lower element 174*b* of connector 174**.

In order to make up and to break connector 174 when gripped by the clamp assemblies, it is necessary to provide relative rotary motion between the upper and lower tongs units about the axis of connector 174. To accomplish this, two hydraulically powered double acting linear actuators 180 and 181 are provided. Secured to lug 122 of bottom plate 108 of unit 105 is a clevis bracket 182 which depends from lug 122 and the legs of which are spaced apart vertically by a distance adequate to freely accommodate the rod end of cylinder 183 of actuator 180 and the cylinder is mounted on bracket 182 by aligned pivot pins 184 secured to and projecting radially from the rod end of the cylinder. The free end of piston rod 185 of actuator 180 is pivotally connected to the end of lug 126 of upper plate 112 of lower tongs unit 106 by clevis 186. As seen in FIG. 16, the free end of lug 126 is displaced upwardly from the plane of plate 112 so that, in the finished assembly, actuator 180 extends parallel to plates 107, 108, 112 and 113 and, therefore, at right angles to the axis of connector 174. Secured to lug 127 of the upper plate of tongs unit 106 is a clevis bracket 187 which projects upwardly from the plane of plate 112. The rod end of cylinder 188 of actuator 181 is pivotally connected to clevis bracket 187, and the free end of piston rod 189 of that actuator is pivotally connected by clevis 190 to the free end of lug 123 of lower plate 108 of the upper tongs unit, the free end of lug 123 being displaced downwardly from the plane of plate 108 to an extent such that actuator 181 is parallel to the top and bottom plates of the tongs units. Actuators 180 and 181 are thus disposed to act along lines which are tangential to a circle drawn about the central axis of connector 174, when the connector is clamped by the tongs units; the cylinder of one actuator is secured to the bottom plate of the upper tongs unit while the free end of the piston rod of that actuator is secured to a point on the top plate of the lower tongs unit; and the cylinder of the other actuator is connected to a point on the top plate of the lower tongs unit while the free end of the rod of that actuator is connected to a point of the bottom plate of the upper tongs units, all of the connections being pivotal. Actuators 180 and 181 are essentially identical and can be operated at the same rate.

To make up connector 174, the frame carrying the power tongs and spinner is positioned at well center, with the connector accommodated by openings 118 and 125, and the clamp assembly of the lower tongs unit is operated to clamp the box **174*b* of the connector. The spinner is then operated to make up the connector to its final stage. The clamp assembly of the upper tongs unit is then operated to clamp pin 174*a*, box 174*b* remaining clamped by the lower tongs unit. Actuators 180 and 181 are now operated to simultaneously retract their piston rods, causing upper tongs unit 105 to rotate clockwise (as viewed from above) relative to tongs unit 106 until tongs unit 105 reaches the position shown in FIG. 19. The torque applied to connector 174 by such rotation of tongs unit 105 is greater than that which can be applied by the spinner and is adequate to accomplish final tightening of the threaded connector. With the connector thus fully made up, both clamping assemblies are operated to release the clamping jaws from the connector, and actuators 180 and 181 are then operated to return upper tongs unit 105 to the position seen in FIG. 17**.

When using the tongs to break threaded connector 174, the frame carrying the tongs and spinner is moved to the well center position, with the jaws of the clamp assemblies open and connector 174 received as shown in FIG. 17. The clamp assembly of the lower tongs unit can then be operated to cause its jaws to clamp box 174b. With the jaws of the clamp assembly of the upper tongs unit still retracted, actuators 180 and 181 are then operated to retract their piston rods and turn upper tongs unit 105 to the position seen in FIG. 19. Power device 143 of upper tongs unit 105 is then operated to extend its piston rod, actuating the jaws of the clamp assembly of that tongs unit to clamp pin **174*a*. Actuators 180 and 181 are then operated to extend their piston rods, returning upper tongs unit 105 to the position shown in FIG. 18 and thereby breaking the threaded connection between pin 174*a* and box 174*b*. The clamp assembly of tongs unit 105 is then operated to actuate its jaws to their retracted position, and the power spinner is then employed to perform the major unthreading operation for removal of pin 174*a* from box 174*b*. Actuators 180 and 181 are constructed and arranged to provide potential break-out torque, i.e., when tongs unit 105 is moved from the FIG. 19 position to the FIG. 18** position, in excess of the make-up torque.

It should be noted that, during clamping operation, the shorter links 150, 152 are placed under a compressive load while the longer links 146, 147 come under a tension load. Due to this reverse loading and to the unequal lengths of the links, the link deflections under load are unequal. Accordingly, the cross-sectional areas of the respective links are predetermined to allow link deflections to maintain transfer of equal forces to the jaw members as clamping is accomplished.

CENTERING DEVICE OF FIGS. 21 AND 22

Figure 21:
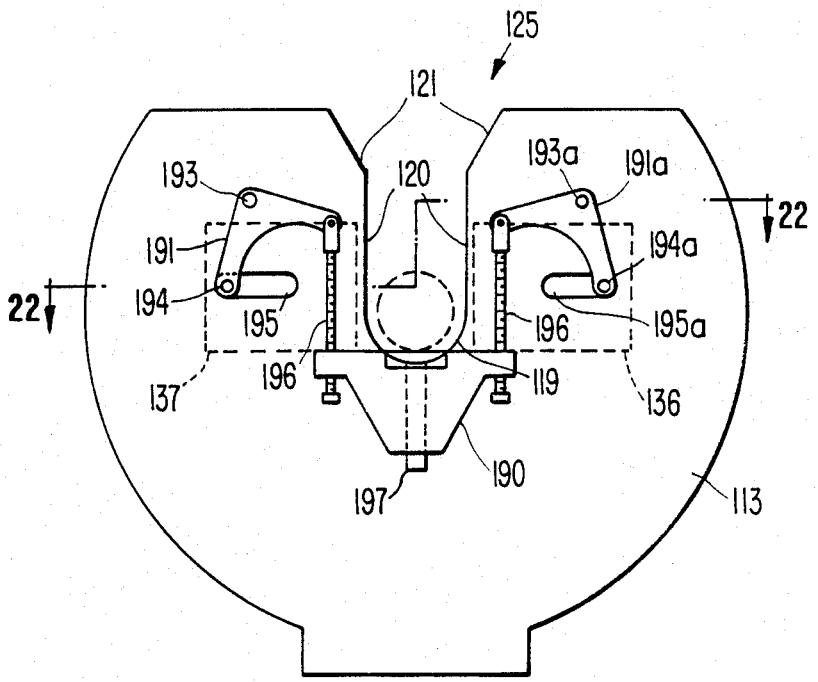
FIG. 21 is bottom plan view of one of the clamp units of the power tongs of FIG. 12 illustrating a centering device according to the invention.
Figure 22:
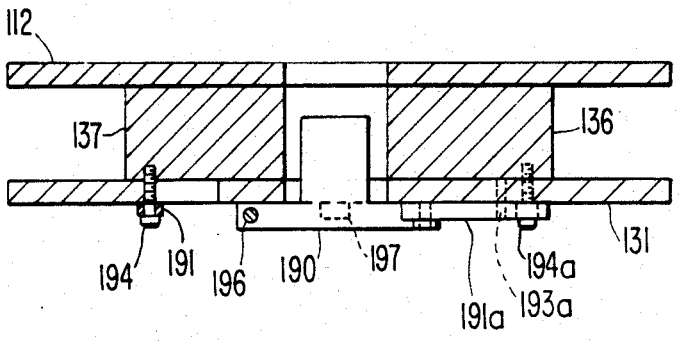
FIG. 22 is a cross-sectional view taken generally on line 22—22, FIG. 21.

Either of tongs units 105, 106 can be equipped with a means for centering the pipe or connector as seen, for example, in FIGS. 21 and 22. Here, a centering member 190 is carried by lower plate 113 of unit 106 in a location centered with respect to arcuate portion 119 of opening 125 and is actuated toward opening 125, simultaneously with movement of the jaw members toward the pipe or connector, by two identical bell crank levers 191 and **191*a* which are pivoted as a result of movement of the jaw members. Bell crank lever 191 is mounted on plate 113 by fixed pivot pin 193 for pivotal movement about its apex, lever 191*a* being similarly mounted by pivot pin 193*a*. One free end of lever 191 is attached to jaw member 137 by a shoulder bolt 194 which passes through an elongated slot 195 in plate 113, the length of the slot extending in the direction of travel of the jaw member. Similarly, one free end of lever 191*a* is attached to jaw member 136 by shoulder belt 194*a* passing through slot 195*a* in plate 113. The other free end of lever 191 is pivotally connected to the foreward end of a link 196, the link being threaded and adjustably secured in a threaded bore in ear 190*a* of centering member 190. In the same fashion, the other free end of lever 191*a* is connected to the foreward end of link 196 which is threadably secured in ear 190*b* at the side of member 190 opposite ear 190*a*. Centering member 190 is constrained by guide 197 to move only along a straight line which extends at right angles to the direction of movement of the jaw members and also extends through the center of the circular peripheral edge of plate 113 and thus midway between side edges 120 of pipe-accommodating opening 118. Since bell crank levers 191 and 191a are identical, are pivoted on plate 113 at points equidistant from the center line of opening 118, and are attached to like points on jaw members 136 and 137, movement of the jaw members toward each other pivots the levers to move centering member 190 forwardly, and the dimensions and pivot locations are so chosen that the rate of movement of member 190 and the distance travelled by member 190 are equal to the rate and distance of travel of each jaw member. Accordingly, the pipe or connector in opening 118 is subject to a 3-point centering action, the jaw members providing two points of contact, member 190** providing the third point of contact.

Control System for Apparatus Shown in FIGS. 1–8

Figure 20:
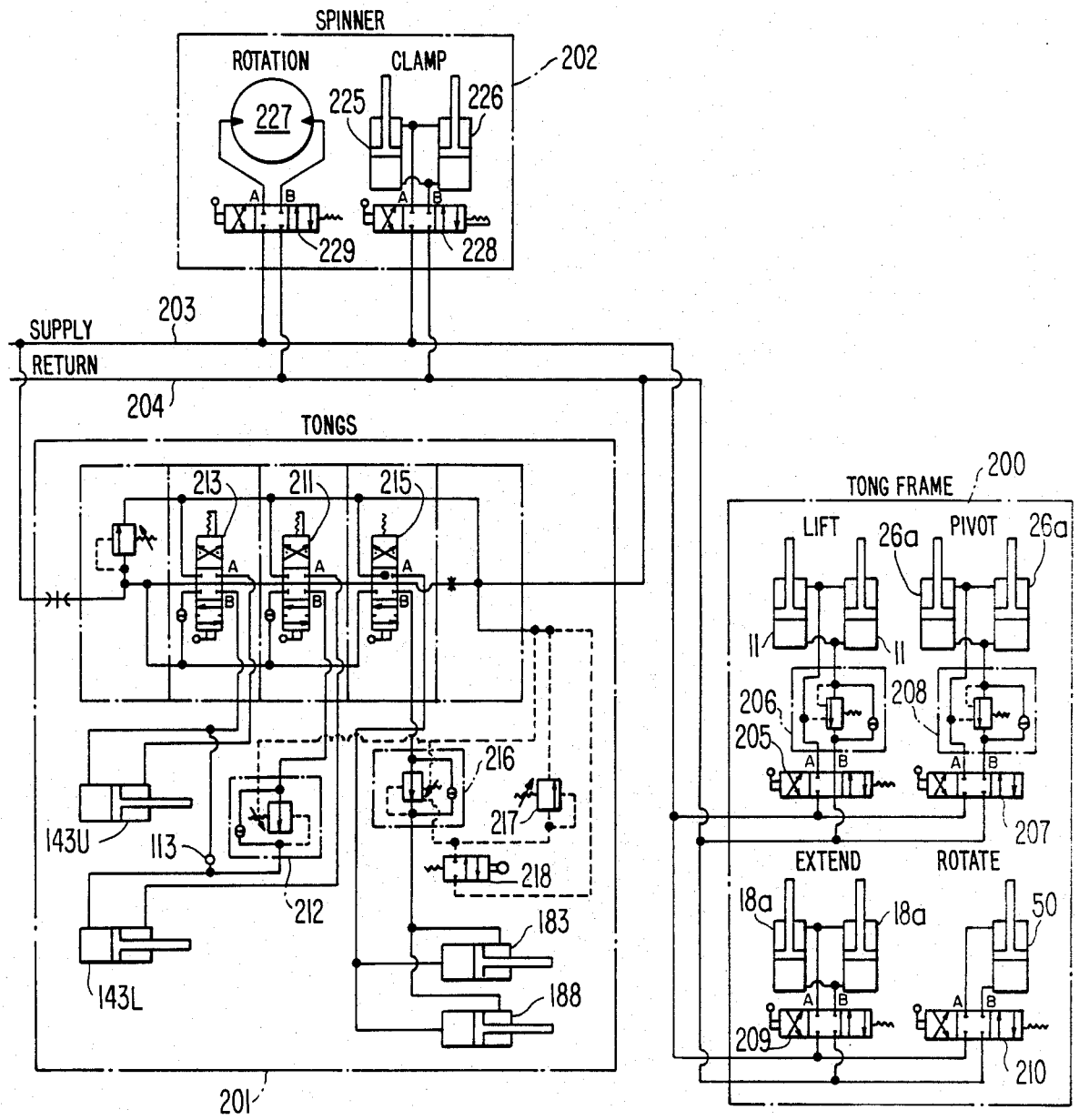
FIG. 20 is a schematic diagram of a hydraulic system for operating the apparatus of FIGS. 1–8 when equipped with the power tongs of FIGS. 12–19.

FIG. 20 illustrates a particularly advantageous hydraulic control system for the apparatus of FIGS. 1–8 when that apparatus is equipped with the power tongs of FIGS. 12–19 and a conventional power spinner, the system comprising portion 200 for operating the power devices for positioning support frame 32, a portion 201 for operating the power tongs and a portion 202 for operating the power spinner, all power components of the system operating from a common pressure fluid supply line 203 and return line 204.

Figure 5:
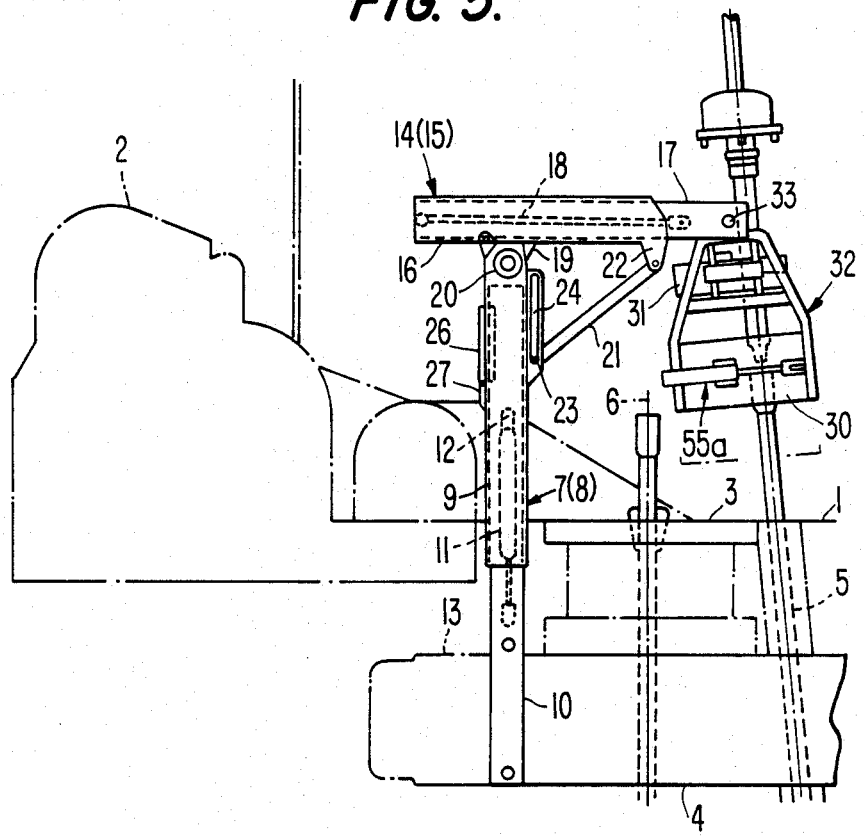
FIG. 5 is a view similar to FIG. 1 but showing the movable support frame in the mousehole position.
Figure 6:
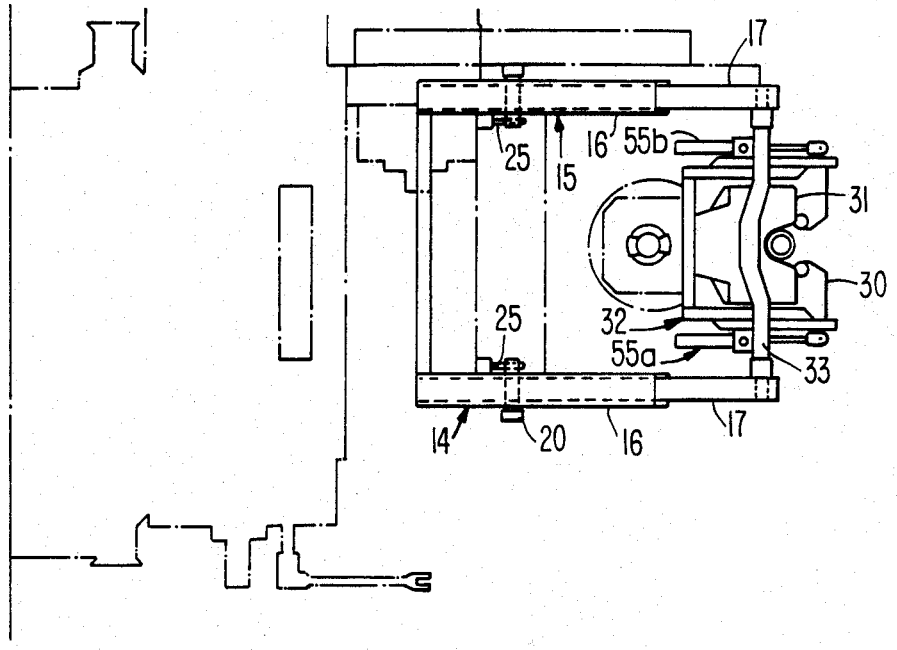
FIG. 6 is a top plan view of the apparatus with the parts in the positions seen in FIG. 5.

In portion 200 of the system, cylinders 11 of the two lift actuators are parallel connected to lines 203 and 204 via a conventional direction control valve, shown diagrammatically at 205, and a conventional counterbalance valve illustrated diagrammatically at 206. Shifting valve 205 to position A causes the lift actuators to retracat their piston rods 13 simultaneously and shorten legs 7 and 8, thereby lowering the combination of support and positioning arms 14, 15 and frame 32. Shifting of valve 205 to position B causes the lift actuators to extend their piston rods simultaneously and thereby extend legs 7 and 8, raising the combination of arms 14, 15 and frame 32. Counterbalance valve 206 is included to prevent oscillation when, with valve 205 in position B, the lift actuators operate to lift the load applied via legs 7 and 8. Cylinders 26a of the linear actuators 26 which swing arms 14 and 15 relative to legs 7 to move frame 32 to and from the stowed position are also connected in parallel to lines 203 and 204 via conventional direction control valve 207 and a conventional counterbalance valve 208. When valve 207 is in position A, actuators 26 simultaneously retract their piston rods to swing arms 14, 15 and frame 32 to the stowed position shown in FIG. 1. Shifting valve 207 to position B causes actuators 26 to extend their piston rods to swing arms 14 and 15 to their horizontal position, seen in FIG. 3. Counterbalance valve 208, again positioned between the direction control valve and the cylinders, prevents oscillation of arms 14 and 15 during operation of the linear actuators. Cylinders 18*a* of linear actuators 18 are connected in parallel to lines 203 and 204 via conventional directional control valve 209. When valve 209 is in position B, cylinders 18a operate to extend the piston rods of actuators 18 simultaneously, thereby extending arms 14 and 15 simultaneously. In position A, valve 209 causes retracation of the piston rods of actuators 18, thereby retracting arms 14 and 15. The cylinder 50 of frame pivot motor 49 is connected to lines 203 and 204 via direction control valve 210. When valve 210 is in position B, motor 49 extends its piston rod, causing frame 32 to pivot counterclockwise relative to arms 14 and 15 to bring the frame into alignment with the mousehole as shown in FIG. 5. Shifting valve 210 to position A causes motor 49 to retract its piston rod, causing frame 32 to return to its vertical position. Valve 210 is also maintained in position B when motor 49 is used to maintain frame 32 vertical as arms 14 and 15 are swung to and from the stowed position.

In portion 201 of the system, cylinder 143L of linear actuator 143 of lower tongs unit 106 is connected to lines 203 and 204 via a conventional direction control valve 211 and a conventional pressure limiting valve 212. When valve 211 is in position A, the actuator retracts its piston rod, retracting the jaws of the lower tongs unit. In position B, the valve causes the actuator to extend its piston rod to move the jaws to clamping position. Pressure limiting valve 212 serves to limit the clamping force applied by the jaws of lower tongs unit 106 until clamping operation of upper tongs unit 105 has commenced. Cylinder 143U of the linear actuator 143 of upper tongs unit 105 is connected to lines 203 and 204 via direction control valve 213. A check valve 214 is connected between the conduits connected to the blind ends of cylinders 143L and 143U and is oriented to block flow from the conduit leading to cylinder 143L. In position A, valve 213 causes the piston rod of cylinder 143U to retract, retracting the jaws of the upper tongs unit. In position B, valve 213 causes the piston rod of cylinder 143U to extend so that the jaws of the upper tongs unit are driven to clamping positions. Once the pressure in the conduit leading to the blind end of cylinder 143U reaches a value exceeding that in the conduit leading to the blind end of cylinder 143L, check valve 214 unseats and equal pressures will be applied to the pistons of both actuators 143 so that the jaws of both tongs units clamp with the same force. Cylinders 183 and 188 of actuators 180 and 181, respectively, are connected in parallel to direction control valve 215 and thus to lines 203 and 204. An adjustable pressure limiting valve 216 is connected between the rod ends of the cylinders and valve 215. An additional pressure limiting valve 217 is connected to valve 216 to act as a bias valve. A two position valve 218 is connected in parallel with valve 217 so as to be capable of, in effect, venting the line in which valve 217 is connected. When valve 215 is in position B, actuators 180 and 181 are operated to retract their piston rods, causing upper tongs unit 105 to turn from the position of FIG. 18 to that shown in FIG. 19, for making up connector 174. With valve 215 in the B position, valve 216 limits the torque applied to connector 174 as the upper tongs unit is turned to the FIG. 19 position, the value to which the torque is limited being determined by the setting of valve 116 and the setting of biasing valve 217. Valve 218 bypasses valve 217 in response to arrival of the piston rods of actuators 180 and 181 at the end of their stroke and thus prevents false torque readings as the actuators "bottom out". When valve 215 is in position B actuators 180 and 181 are operated to extend their piston rods and thus return the upper tongs unit from the position shown in FIG. 19 to that seen in FIG. 18, as is required for breaking threaded connector 174.

Conventional power spinners suitable for use in accordance with the invention can comprise linear actuators for actuating the pipe clamp, the actuators having cylinders 225 and 226. A rotary power device 227 is used to spin the pipe. In portion 202 of the control system, cylinders 225 and 226 are connected in parallel to lines 203 and 204 via conventional direction control valve 228. Rotary power device 227 is connected to lines 203 and 204 via direction controlling valve 229. It will be apparent that valve 228 can be adjusted to cause the pipe clamp to clamp or release, and that the direction of rotation of device 227 can be selected by operation of valve 229.

OPERATION OF THE APPARATUS OF FIGS. 1–8 USING CONTROL SYSTEM SHOWN IN FIG. 20

Assuming that support arms 14, 15 and frame 32 are in the stowed position shown in FIG. 1, the operational sequence to make up threaded pipe connector 174 is as follows:

Step 1. Shift valve 207 to position B, to cause actuators 26 to extend their piston rods and swing arms 14 and 15 from vertical to horizontal. Simultaneously, shift valve 210 to position B, causing actuator 49 to extend its piston rod at a rate maintaining frame 32 in its vertical position as arms 14 and 15 swing.

Step 2. Shift valve 205 to position B, causing the piston rods of cylinders 11 to extend, increasing the length of legs 7 and 8 to raise frame 32 to the proper height for the power tongs to function.

Step 3. Shift valve 228 to position B, causing cylinders 225, 226 to extend their piston rods so that the clamping device of the spinner clamps onto the upper joint of pipe.

Step 4. Shift valve 211 to position B, causing actuator 143 of lower tongs unit 106 to extend its piston rod and actuate the clamping device of unit 106 to clamp box 174*b* of the connector, valve 212 serving to limit the maximum clamping pressure to the level preset by the operator.

Step 5. Shift valve 229 to position B to cause power device 227 to rotate the upper joint of pipe until pin 174*a* is spun into the box.

Step 6. Shift valve 228 to position A to release the clamping device of the spinner from the pipe.

Step 7. Shift valve 213 to position B to operate actuator 143 of upper tongs unit 105 to actuate the jaws of unit 105 into clamping engagement with pin 174 of the connector. Once the hydraulic pressure in cylinder 143U equals that in cylinder 143L, both tongs units will operate to clamp with the same force.

Step 8. Shift valve 215 to position B, causing actuators 180 and 181 to retract their piston rods and thereby rotate upper tongs unit 105 from the position seen in FIG. 19 to that of FIG. 18. Once the torque on the threaded connector reaches the value preset by adjusting valve 216, the connector has been properly torqued and cylinders 183 and 188 are deenergized.

Step 9. Shift valves 213 and 211 to position A, causing actuators 143 of both tongs units to actuate the jaws of the tongs units to released positions.

Step 10. Shift valve 215 to position A, causing actuators 180 and 181 to extend their piston rods and rotate tongs unit 105 back to the position shown in FIG. 18.

Step 11. For mousehole operation, shift valve 205 to position B, causing the piston rods of cylinders 11 to further extend, raising frame 32 enough for pass over clearance with respect to the joint of pipe remaining in the slips at the rig floor, then shift valve 209 to position B to cause actuators 18 to extend arms 14 and 15 to bring frame 32 to the mousehole position.

Step 12. Shift valve 210 to position B, causing motor 49 to extend its piston rod and rotate frame 32 into alignment with the mousehole receptacle.

Step 13. Repeat Steps 2–9.

Step 14. Shift valve 209 to position A to cause return of frame 32 to the well center position.

It will be apparent that the procedure of breaking a threaded connector is essentially the reverse of that described above for making up the connector. Adaption of the control system and operation procedure to the apparatus shown in FIGS. 9–11 will also be apparent.

What is claimed is:

1. In a clamping unit for power tongs to be used for making and breaking threaded pipe connections, the combination of rigid support means having a front, a back and two sides, the support means having an opening to accommodate a pipe or a threaded connector member, the opening extending through the front of the support means so that relative lateral movement between the support means and a pipe or connector member can cause the pipe or connector member to be situated in a predetermined position in the opening, the support means being adapted to be so mounted in a power tongs as to be rotatable about the longitudinal axis of the pipe connection to be made or broken;

two opposed jaw members each disposed between the opening and a different side of the support means, the jaw members being supported for rectilinear movement toward and away from the opening so as to be capable of being engaged with and disengaged from a pipe or connector member disposed in the opening;

two jaw actuating levers each disposed between a different one of the sides of the support member and the one of the jaw members nearer such side, each of the jaw actuating levers being mounted on the support means for pivotal movement about an axis parallel to the axis of rotation of the support means, each of the levers having a front portion projecting forwardly from the axis of pivotal movement of the lever, and a back portion projecting rearwardly from the axis of pivotal movement of the lever;

remotely operable double acting linear power device connected between the ends of the back portions of the jaws actuating levers and operative to pivot the levers in a first direction when the power device operates in one direction and a second direction when the power device operates in the opposite direction; and linkage means interconnecting the jaw members and the jaw actuating levers to move the jaw members toward each other, to clamp the pipe or connector member, when the power device is operated in said one direction, and away from each other, to release the pipe or connector member, when the power device is operated in said opposite direction, the linkage means comprising first means interconnecting the front portions of the levers and the respective jaw members but leaving the opening free for entry of the pipe or connector member, and second means interconnecting the back portions of the levers and the respective jaw members and being located between the power device and the opening.

2. The combination defined by claim 1, wherein said first means of the linkage means comprises a first link having its ends pivotally connected respectively to the front portion of one of the jaw actuating levers and a frontal part of the jaw member nearer that lever, and a second link having its ends pivotally connected respectively to the front portion of the other of the jaw actuating levers and a frontal part of the other jaw member, the portions of the first and second links which are pivotally connected to the respective jaw members being spaced from the opening which accommodates the pipe or connector member.

3. The combination defined by claim 1, wherein said second means of the linkage means comprises a first link having one end pivotally connected to the back portion of one of the jaw actuating levers in a location spaced from the pivotal axis of that lever, the other end of said first link being pivotally connected to a back portion of the jaw member most distant from said one lever, and a second link having one end pivotally connected to the back portion of the other of the jaw actuating levers in a location spaced from the pivotal axis of that lever, the other end of said second link being pivotally connected to the back portion of the other of the jaw members.

4. The combination defined by claim 3, wherein the jaw members are each provided with a rearwardly projecting clevis bracket the arms of which are spaced apart in a direction parallel to the pivotal axes of the jaw actuating levers, the clevis brackets being mutually aligned so that the arms of one bracket lie in respectively common planes with the arms of the other bracket;

said first link of said second means of the linkage means extending between the arms of both clevis brackets, said other end of said first link being pivoted to the clevis bracket carried by said jaw member most distant from said lever, said first link having a longitudinally extending slot to freely accommodate a pivot pin carried by the arms of the other clevis bracket; and said second link of said second means of the linkage means being spaced from said first link in a direction parallel to the pivotal axes of the jaw actuating levers so that said second link bypasses the clevis bracket to which said other end of said first link is connected, said other end of said second link being connected to the pivot pin carried by the arms of said other clevis bracket.

5. The combination defined by claim 4, wherein said other end of said second link is connected to the upper end of said pivot pin; and said second means of the linkage means comprises a third link identical to said second link, said third link being located below said first link and having one end connected to the low end of said pivot pin.

6. The combination defined by claim 1, wherein the rigid support means comprises a lower plate; th jaw actuating levers are each pivotally mounted on the lower plate by shafts projecting upwardly from the plate.

7. The combination defined by claim 6, wherein the lower plate has upwardly opening guideway means extending across the opening which accommodates the connection to be made or broken, the guideway means being located in front of said second means of the linkage means, said jaw members being slidably engaged in the guideway means.

8. The combination defined by claim 6, wherein the rigid support means comprises an upper plate spaced above the lower plate, and means rigidly connecting the paper plate to the lower plate;

the combination of the jaw members, jaw actuating levers, a power device and linkage means being located between the upper and lower plates, the shafts which pivotally mount the jaw actuating levers on the lower plate also being engaged with the upper plate.

9. The combination defined by claim 8, wherein the rigid support means further comprises an intermediate partition located between the power device and said second means of the linkage means, and two front plates located at the mouth of the opening which accommodates the connection to be made or broken, the intermediate partition and the front plates rigidly interconnecting the upper and lower plates.

10. In a power tongs unit for making and breaking threaded pipe connections, the combination of a support frame having a front and a back and being open at the front to accommodate the threaded pipe connection to be made or broken;

two clamping units carried by the support frame and each comprising a rigid support having a front, a back and two sides and having an opening extending through the front of the rigid support, the rigid support being so located relative to the support frame that the front of the rigid support and the front of the support frame face in the same direction, the opening of the rigid support being dimensioned to accommodate the threaded pipe connection to be made or broken, the rigid support of at least one of the clamping units being so mounted on the support frame as to be rotatable relative to the support frame about the longitudinal axis of the threaded connection to be made or broken, two opposed jaw members each disposed between the opening and a different side of the support means, the jaw means being support for rectilinear movement toward and away from the opening so as to be capable of being engaged with and disengaged from a pipe or connector member disposed in the opening;

two jaw actuating levers each disposed between a different one of the sides of the rigid support and the one of the jaws nearer such side, each of the jaw actuating levers being mounted on the rigid support for pivotal movement about an axis parallel to the axis of rotation of the rigid support, each of the levers having a front portion projecting forwardly from the axis of pivotal movement of the lever, and a back portion projecting rearwardly from the axis of pivotal movement of the lever, a remotely operable double acting linear power device connected between the ends of the back portion of the jaw actuating levers and operative to pivot the levers in a first direction when the power device operates in one direction and a second direction when the power device operates in the opposite direction, and linkage means interconnecting the jaw members and the jaw actuating levers to move the jaw members toward each other, to clamp one part of the threaded connection to be made or broken, when the power device is operated in said one direction, and away from each other, to release the threaded connection, when the power device is operated in said opposite direction, the linkage means comprising first means interconnecting the front portions of the levers and the respective jaw members but leaving the opening of the rigid support free for entry of the threaded pipe connection to be made or broken, and second means interconnecting the back portions of the levers and respective jaw members and being located between the power device and the opening of the rigid support; and remotely operable power means connected to the clamping units for rotating one of the clamping units relative to the other.

11. The combination defined by claim 10, wherein the rigid support of each clamping unit comprises first and second plates which are spaced apart and secured rigidly together, the combination of the jaw members, actuating levers, linear power device and linkage means being disposed between the first and second plates, the two clamping units being so disposed that the first plate of one clamping unit is adjacent to the second plate of the other clamping unit; and the remotely operated power means for rotating one of the clamping units relative to the other comprises a first double acting linear power device of the piston and cylinder type having its piston rod pivotally connected to the first plate of said one clamping unit and its cylinder pivotally connected to the second plate of said other clamping unit, and a second double acting linear poewr device of the piston and cylinder type having its piston rod pivotally connected to the second plate of said other clamping unit and its cylinder pivotally connected to the first plate of said one clamping unit.

12. The combination defined by claim 11, wherein for each of the first and second linear power devices, the cylinder is connected to the respective plate by a clevis bracket and the free end of the piston rod is connected to the respective plate by means including a lug projecting from the respective plate, the brackets and lugs being offset from the planes of the plates so that both the first and second linear power devices in a common plane parallel to and between the first plate of said one clamping unit and the second plate of said other clamping unit.

13. The combination defined by claim 11, wherein the free ends of the piston rods of the first and second linear power devices are connected to the respective plates adjacent the front of the clamping units and the rod ends of the cylinders of the first and second linear power devices are connected to the respective plates at points spaced rearwardly from the fronts of the clamping units.

14. The combination defined by claim 11, wherein the first and second linear power devices are located outside of the support frame.

* * * * *